US009516437B2

(12) United States Patent
van Halteren et al.

(10) Patent No.: US 9,516,437 B2
(45) Date of Patent: Dec. 6, 2016

(54) TRANSDUCER COMPRISING MOISTURE TRANSPORTING ELEMENT

(71) Applicant: Sonion Nederland BV, Hoofddorp (NL)

(72) Inventors: Aart Zeger van Halteren, Hobrede (NL); Laurens de Ruijter, Haarlem (NL); Nicolaas Maria Jozef Stoffels, Haarlem (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 14/487,224

(22) Filed: Sep. 16, 2014

(65) Prior Publication Data

US 2015/0078603 A1 Mar. 19, 2015

Related U.S. Application Data

(60) Provisional application No. 61/878,129, filed on Sep. 16, 2013.

(51) Int. Cl.
*H04R 25/00* (2006.01)
*H04R 1/02* (2006.01)

(52) U.S. Cl.
CPC ..... *H04R 25/65* (2013.01); *H04R 1/02* (2013.01); *H04R 25/654* (2013.01); *H04R 2225/025* (2013.01); *H04R 2460/11* (2013.01)

(58) Field of Classification Search
CPC ..... H04R 1/02; H04R 2460/11; H04R 19/005; H04R 1/225; H04R 23/008
USPC ..... 381/328–330, 322, 323, 312, 325, 69,381/68.6, 392, 393, 324; 219/386, 392, 400; 134/35, 61
See application file for complete search history.

(56) References Cited

U.S. PATENT DOCUMENTS

| | | | |
|---|---|---|---|
| 6,788,796 | B1 | 9/2004 | Miles et al. |
| 6,831,577 | B1 | 12/2004 | Furst |
| 6,853,290 | B2 | 2/2005 | Jorgensen et al. |
| 6,859,542 | B2 | 2/2005 | Johannsen et al. |
| 6,888,408 | B2 | 5/2005 | Furst et al. |
| 6,914,992 | B1 | 7/2005 | van Halteren et al. |
| 6,919,519 | B2 | 7/2005 | Ravnkilde et al. |

(Continued)

FOREIGN PATENT DOCUMENTS

| | | | |
|---|---|---|---|
| EP | 1653767 | A2 | 5/2006 |
| EP | 1653767 | A3 | 11/2008 |

(Continued)

OTHER PUBLICATIONS

Extended European Search Report corresponding to co-pending European Patent Application Serial No. EP14184746.7, European Patent Office, dated Jan. 29, 2015; (3 pages).

(Continued)

*Primary Examiner* — Quoc D Tran
*Assistant Examiner* — Julie X Dang
(74) *Attorney, Agent, or Firm* — Nixon Peabody LLP

(57) ABSTRACT

A hearing aid or a transducer for use in a hearing aid, having a housing with an opening from an inner chamber thereof to surroundings thereof. A moisture transporting element is positioned in the opening. The moisture transporting element may be capillary channels or a thread made of fibers which may fan out at the outer side in order to increase evaporation. The chamber may be hydrophobic and surroundings of the opening be hydrophilic to encourage humidity to travel toward the humidity transporting element to be removed from the chamber.

17 Claims, 2 Drawing Sheets

(56) References Cited

U.S. PATENT DOCUMENTS

| | | | |
|---|---|---|---|
| 6,930,259 | B1 | 8/2005 | Jorgensen et al. |
| 6,943,308 | B2 | 9/2005 | Ravnkilde et al. |
| 6,974,921 | B2 | 12/2005 | Jorgensen et al. |
| 7,008,271 | B2 | 3/2006 | Jorgensen |
| 7,012,200 | B2 | 3/2006 | Moller |
| 7,062,058 | B2 | 6/2006 | Steeman et al. |
| 7,062,063 | B2 | 6/2006 | Hansen et al. |
| 7,072,482 | B2 | 7/2006 | Van Doorn et al. |
| 7,088,839 | B2 | 8/2006 | Geschiere et al. |
| 7,110,560 | B2 | 9/2006 | Stenberg |
| 7,136,496 | B2 | 11/2006 | van Halteren et al. |
| 7,142,682 | B2 | 11/2006 | Mullenborn et al. |
| 7,181,035 | B2 | 2/2007 | van Halteren et al. |
| 7,190,803 | B2 | 3/2007 | van Halteren |
| 7,206,428 | B2 | 4/2007 | Geschiere et al. |
| 7,221,767 | B2 | 5/2007 | Mullenborn et al. |
| 7,221,769 | B1 | 5/2007 | Jorgensen |
| 7,227,968 | B2 | 6/2007 | van Haltren et al. |
| 7,239,714 | B2 | 7/2007 | de Blok et al. |
| 7,245,734 | B2 | 7/2007 | Niederdraenk |
| 7,254,248 | B2 | 8/2007 | Johannsen et al. |
| 7,286,680 | B2 | 10/2007 | Steeman et al. |
| 7,292,700 | B1 | 11/2007 | Engbert et al. |
| 7,292,876 | B2 | 11/2007 | Bosh et al. |
| 7,336,794 | B2 | 2/2008 | Furst et al. |
| 7,376,240 | B2 | 5/2008 | Hansen et al. |
| 7,403,630 | B2 | 7/2008 | Jorgensen et al. |
| 7,415,121 | B2 | 8/2008 | Mögelin et al. |
| 7,425,196 | B2 | 9/2008 | Jorgensen et al. |
| 7,460,681 | B2 | 12/2008 | Geschiere et al. |
| 7,466,835 | B2 | 12/2008 | Stenberg et al. |
| 7,492,919 | B2 | 2/2009 | Engbert et al. |
| 7,548,626 | B2 | 6/2009 | Stenberg et al. |
| 7,657,048 | B2 | 2/2010 | van Halteren et al. |
| 7,684,575 | B2 | 3/2010 | van Halteren et al. |
| 7,706,561 | B2 | 4/2010 | Wilmink et al. |
| 7,715,583 | B2 | 5/2010 | Van Halteren et al. |
| 7,728,237 | B2 | 6/2010 | Pedersen et al. |
| 7,809,151 | B2 | 10/2010 | Van Halteren et al. |
| 7,822,218 | B2 | 10/2010 | Van Halteren |
| 7,899,203 | B2 | 3/2011 | Van Halteren et al. |
| 7,912,240 | B2 | 3/2011 | Madaffari et al. |
| 7,946,890 | B1 | 5/2011 | Bondo et al. |
| 7,953,241 | B2 | 5/2011 | Jorgensen et al. |
| 7,961,899 | B2 | 6/2011 | Van Halteren et al. |
| 7,970,161 | B2 | 6/2011 | van Halteren |
| 8,098,854 | B2 | 1/2012 | van Halteren et al. |
| 8,101,876 | B2 | 1/2012 | Andreasen et al. |
| 8,103,039 | B2 | 1/2012 | van Halteren et al. |
| 8,160,290 | B2 | 4/2012 | Jorgensen et al. |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman et al. |
| 8,233,652 | B2 | 7/2012 | Jorgensen et al. |
| 8,259,963 | B2 | 9/2012 | Stenberg et al. |
| 8,259,976 | B2 | 9/2012 | van Halteren |
| 8,259,977 | B2 | 9/2012 | Jorgensen et al. |
| 8,280,082 | B2 | 10/2012 | van Halteren et al. |
| 8,284,966 | B2 | 10/2012 | Wilk et al. |
| 8,313,336 | B2 | 11/2012 | Bondo et al. |
| 8,315,422 | B2 | 11/2012 | van Halteren et al. |
| 8,331,595 | B2 | 12/2012 | van Halteren |
| 8,369,552 | B2 | 2/2013 | Engbert et al. |
| 8,379,899 | B2 | 2/2013 | van Halteren et al. |
| 8,509,468 | B2 | 8/2013 | van Halteren et al. |
| 8,526,651 | B2 | 9/2013 | Lafort et al. |
| 8,526,652 | B2 | 9/2013 | Ambrose et al. |
| 2001/0050996 | A1 | 12/2001 | Baker |
| 2005/0169491 | A1* | 8/2005 | Pitt ..... H04R 25/456 381/322 |
| 2005/0249369 | A1* | 11/2005 | Angst ..... H04R 25/48 381/322 |
| 2006/0153418 | A1* | 7/2006 | Van Halteren ..... H04R 9/063 381/396 |
| 2007/0047752 | A1* | 3/2007 | Wagner ..... H04R 25/658 381/330 |
| 2008/0006010 | A1* | 1/2008 | Lamont ..... H05K 5/0213 55/385.6 |
| 2008/0310660 | A1* | 12/2008 | Lin ..... H04R 1/086 381/322 |
| 2009/0074219 | A1 | 3/2009 | Klemenz et al. |
| 2009/0130423 | A1* | 5/2009 | Keady ..... H04R 17/00 428/304.4 |
| 2009/0154747 | A1* | 6/2009 | Vestergaard ..... H04R 25/654 381/325 |
| 2009/0208045 | A1 | 8/2009 | Reithinger et al. |
| 2010/0040250 | A1* | 2/2010 | Gebert ..... H04R 25/654 381/316 |
| 2010/0322454 | A1 | 12/2010 | Ambrose et al. |
| 2011/0124483 | A1* | 5/2011 | Shah ..... B82Y 30/00 501/32 |
| 2011/0182452 | A1* | 7/2011 | Lin ..... H04R 25/658 381/325 |
| 2011/0182453 | A1 | 7/2011 | van Hal et al. |
| 2011/0189880 | A1 | 8/2011 | Bondo et al. |
| 2011/0299708 | A1 | 12/2011 | Bondo et al. |
| 2011/0299712 | A1 | 12/2011 | Bondo et al. |
| 2011/0311069 | A1 | 12/2011 | Ambrose et al. |
| 2012/0014548 | A1 | 1/2012 | van Halteren |
| 2012/0027245 | A1 | 2/2012 | van Halteren et al. |
| 2012/0140966 | A1 | 6/2012 | Mocking et al. |
| 2012/0155683 | A1 | 6/2012 | van Halteren |
| 2012/0155694 | A1 | 6/2012 | Reeuwijk et al. |
| 2012/0255805 | A1 | 10/2012 | van Halteren et al. |
| 2013/0028451 | A1 | 1/2013 | de Roo |
| 2013/0136284 | A1 | 5/2013 | van Hal et al. |
| 2013/0142370 | A1 | 6/2013 | Engbert et al. |
| 2013/0163799 | A1 | 6/2013 | Van Halteren |
| 2013/0195295 | A1 | 8/2013 | van Halteren et al. |

FOREIGN PATENT DOCUMENTS

| | | | |
|---|---|---|---|
| EP | 2348757 | A1 | 7/2011 |
| WO | 2004/032567 | A1 | 4/2004 |

OTHER PUBLICATIONS

European Examination Report corresponding to co-pending European Patent Application No. 14184746.7, European Patent Office, dated Sep. 22, 2016; (6 pages).

* cited by examiner

TRANSDUCER COMPRISING MOISTURE TRANSPORTING ELEMENT

CROSS-REFERENCE TO RELATED APPLICATION

This application claims the benefit of U.S. Provisional Patent Application No. 61/878,129, filed Sep. 16, 2013, entitled "A Transducer Comprising Moisture Transporting Element" which is hereby incorporated by reference in its entirety.

FIELD OF THE DISCLOSURE

The present invention relates to a transducer comprising a moisture transporting element and in particular to a transducer having a chamber where most of the inner surface of the chamber is hydrophobic but were a hydrophilic surface part exists at the moisture transporting element.

BACKGROUND

Transducers are often exposed to the environment, whereby, in certain circumstances, moisture can enter the transducer. This could especially happen if the receiver is inside the ear canal, which is a warm and humid environment, where the transducer housing has a lower temperature than the air in the ear canal, which will be the situation e.g. when the receiver is thermally connected to the outside world. Warm air with a high relative humidity enters the cooler transducer, where the air cools and the relative humidity increases. If the relative humidity reaches 100%, condensation takes place, causing water droplets in the transducer. These droplets tend to at least temporarily degrade the performance of the transducer. In some situations, condensed water can cause damage to the motor/sensor of the transducer.

SUMMARY

It is an object to remove such condensed water from transducers.

In a first aspect, the invention relates to a transducer comprising a housing having:

- a wall portion defining an outer surface and an inner surface, the inner surface defining at least part of a first chamber, the wall portion comprising an opening from the inner surface to the outer surface,
- a diaphragm having a first surface defining at least a part of the first chamber,
- moisture transporting element positioned in the opening.

In this context, a transducer is an element configured to sense a physical property, such as sound, vibration, acceleration or the like, or configured to generate a physical change, such as sound, vibration or the like.

The housing may be made of any suitable material, such as a metal, an alloy, plastics, rubber, polymer or a combination thereof.

The first chamber may comprise a further opening for receiving or outputting sound, if the transducer is configured to generate or sense sound. Alternatively, the housing may in that situation comprise a second chamber having a further opening for receiving or outputting sound. This second chamber may be defined by another wall portion of the housing and a second surface, typically a second side, of the diaphragm opposite to the first surface of the diaphragm. In this situation, the housing may define therein the first and the second chambers, which are separated from each other by the diaphragm.

If the transducer is for sensing or generating vibration or acceleration, no further output may be needed, as may no second chamber.

The diaphragm usually is a rather thin, plane element which is sufficiently stiff to move at least substantially as a plane element, even when hinged at e.g. one side, and when either moved by a motor unit or when moved by received sound or vibration. The diaphragm preferably is attached to the wall portion or the inner surface in a manner so as to form an at least substantially gas tight seal of the first chamber.

The diaphragm may have a thickness of 0.5-0.75 μm and may be made of e.g. Ni, AL, Mylar polyester film or PPS (polypropylene sulphide)

Naturally, the wall portion of the housing may define any part of the first chamber. Additional elements may also take part in the defining of the first chamber, such as elements attached to the inner surface and thus forming an effective part of the surface defining the first chamber.

When the wall portion has an inner and an outer surface, the wall portion usually is solid, monolithic or non-hollow, at least in a thickness direction, so that the same layer or sheet of material forms on one side the inner surface and on an opposite side the outer surface. Alternatively, the housing may be formed by multiple housings or multiple walls within each other.

The wall portion may be formed by a number of elements or housing portions if desired. Often, housings are made of different shell-shaped portions inside which the diaphragm and potentially other elements are encapsulated by the shell-shaped portions.

The first chamber may be acoustically closed, or one or more additional openings may be present therein, such as the above second opening.

A pressure relief vent may also be present for equalizing any pressure difference between the chamber and the surroundings. This vent may be dimensioned and/or provided so as to not interfere with the operation of the transducer. In relation to microphones or sound generators, the vent may be able to only transport sound with a frequency below a predetermined cut-off frequency.

In relation to microphones, sound generators, vibration generator/sensor, accelerometer or the like, additional elements may also be provided, such as an opening for outputting or receiving sound and a motor for driving the diaphragm to generate sound/vibration or a sensor for sensing movement of the diaphragm due to received sound/vibration/acceleration or the like.

The opening extends through the wall portion, so that the moisture transporting element is allowed to extend at least from the inner surface to the outer surface. Thus, moisture may be transported from the inner surface toward and to the outer surface by the moisture transporting element positioned in the opening.

The moisture transporting element may be transporting the moisture using any of a number of different manners or technologies. Thus, many different types of moisture transporting elements are feasible.

In one embodiment, the moisture transporting element comprises one or more capillary channels. These capillary channels may be provided in the actual wall portion, so that the opening is a portion of the wall portion where the capillary channel(s) is/are. Alternatively, the moisture transporting element may be a separate element provided in the opening and having the channel(s).

Multiple types of elements are known which comprise or form capillary channels. A solid element may be provided with channels in order to obtain this function, or a number of elongate elements may be assembled or bundled to there between generate or form the channels.

In one embodiment, the moisture transporting element comprises a fibre. This fibre may be formed by a plurality of elongate elements bundled and potentially wound/rotated or the like.

Depending on the characteristics of the fibre and/or elongate elements forming the fibre, capillary channels may be formed in the fibre, such as when the fibre is hydrophobic. Alternatively, the fibre may be absorbing or hydrophilic, whereby the moisture may transported therein by polar interaction, water being a dipole and e.g. a polymer fibre being polar.

In the present context, the definition of hydrophobic and hydrophilic may be that a hydrophobic material has a contact angle of 90° or more, where a super hydrophobic material has a contact angle of 150° or more.

Hydrophilic materials may be organic materials, such as cotton, microfiber, Kapton or polypropylene.

Hydrophobic materials may be material, such as Teflon or carbon fabric. Naturally, a material or element may be made hydrophobic by providing it with a hydrophobic surface, if desired.

Irrespective of the manner of liquid transport, the liquid will as a result be provided to or at the outer surface from where it may evaporate.

In general, the moisture transporting element comprises a hydrophilic element. Above, a fibre is mentioned as an example. Also other types of hydrophilic elements are known, such as weaves, non-woven, foams and solid, hydrophilic element wherein water may be transported.

Alternatively, in general, the moisture transporting element may comprise a hydrophobic element, such as when also provided with or forming capillary channels.

Preferably, the moisture transporting element comprises an outer part positioned at or outside the outer surface. In this manner, evaporation of the liquid from the moisture transporting element is facilitated.

In one situation, the outer part is positioned outside the outer surface in order to have an increased surface of the outer part exposed outside the outer surface. This may facilitate evaporation of liquid.

The outer part may comprise a hydrophilic element or material irrespective of which manner is used for transporting liquid through the moisture transporting element. A problem seen in e.g. capillary channels is that as easy it is to introduce liquid therein, as difficult is it to remove it again without using active pushing/suction. However, if a part of the channel is hydrophilic or the channel is in contact with a hydrophilic material, the liquid may be transported through the hydrophilic material not using the capillary effect, whereby liquid may be removed from the capillary channel.

In that situation, or in another situation, the outer part may comprise a water absorbing element or material which may have the same overall effect described above.

The outer part may be made of the same material, have the same structure and/or the same water transporting capability as a remaining portion of the moisture transporting element or a portion thereof.

The material/structure/capability of the outer part may extend into other parts of the moisture transporting element, such as into channels thereof or parts thereof forming channels.

In one embodiment, the outer part has a shape which, compared to a cross section of the opening, fans out in a direction away from the housing. This fanning out may be an increase in cross section of the outer part perpendicular to a general direction of the opening. The outer part thus may be wedge-shaped. In another situation, the outer part is formed by or comprises elongate elements, where a distance between these elements may increase to generate the fanning out.

This fanning out may increase the overall surface of the outer element and thus facilitate or increase evaporation there from.

In one situation, it is preferred to avoid contamination of the outer part, the outer part is covered by a breathable element, such as a weave, non-woven or a fabric. In this situation, the outer part may be provided in a cavity formed at the outer surface, where the breathable element may then be provided in a plane of a part of the outer surface not forming the cavity so as to generate, with the cavity part of the outer surface, an enclosure in which the outer part may be provided.

In a preferred embodiment, a predetermined area of the inner surface at or around the opening is hydrophilic and other parts of the inner surface are hydrophobic. Preferably, all other parts of the wall portion, such as all surfaces of the first chamber including the first surface of the diaphragm, than the predetermined area are hydrophobic, so that liquid will not tend to stick to such surfaces but will be able to move, such as a result of the gravity and rotation/movement of the transducer. In this situation, water droplets will tend to travel over the hydrophobic surfaces but stick to the hydrophilic surface for a relatively longer period of time so as to have time to come into contact with the moisture transporting element and thus be removed from the first chamber.

The predetermined area may alternatively be absorbing, such as provided with an absorbing coating or element.

The predetermined area may be selected in accordance with the size of the transducer, but a suitable area is 0.1-10, such as 0.2-5, such as 0.5-2, times an area of a water droplet or at least the area of contact of the droplet and the hydrophilic area.

On the one hand, the area is preferred to have a sufficient size for the droplet to engage and be attached to. On the other hand, the area should be sufficiently small for the attached droplet to get into contact with the moisture transporting element.

Also the position of the hydrophilic area and thus the opening may be selected so that, during normal operation of the transducer, the area and opening are at a lower surface of the first chamber so that gravity will ensure that the water droplet will easily come into contact with the hydrophilic area. In this situation, usual operation will depend on the transducer type and where it is intended to be used.

Some acceleration/vibration sensors are intended to be fixed to machinery or the like and may be intended to be fixed with a predetermined outer surface thereof pointing upwards.

For transducers for hearing aids, hearing aids are usually designed to be fixed or attached to a person, so that the usual operation may be that of a user standing up while wearing the hearing aid. In that situation, the transducer may be incorporated into the hearing aid in the desired manner.

Naturally, the housing may have several chambers which may all have a moisture transporting element if desired.

A second aspect of the invention relates to a hearing aid comprising a transducer according to the first aspect and a hearing aid housing, the hearing aid housing having:

a first surface and a second surface opposite to the first surface, a hearing aid opening configured to be directed into the ear canal of a user, the hearing aid opening being positioned in the first surface, where the opening is positioned in or at the second surface.

In this context, a hearing aid may be an element configured to output an audio signal for a user to hear. Multiple types of hearing aids are seen of which a number of types have at least a part for positioning within the ear canal of a user or for positioning at or near the entrance of the ear canal to feed sound toward and into the ear canal.

In some hearing aids, the sound generator is positioned within an element in the ear canal. In other hearing aids, the sound generator is positioned in an element worn on or behind the ear, where sound is guided to an element positioned in the ear canal in a sound guide.

The above humidity problem is the most severe in elements or housings positioned in the ear canal and especially in housings having an opening pointing inwardly in the ear canal.

In some hearing aids, a microphone is positioned in the ear canal. Often, a microphone is configured to sense sound from the surroundings and thus has a sound receiving opening directed outwardly of the ear canal. However, hearing aids have been described having a microphone configured to sense the sound in the ear canal, so as to e.g. form the basis of a compensation of the sound provided to the ear canal. In this situation, the microphone will have a sound receiving opening directed toward the ear canal.

In the present context, the hearing aid housing may be configured or dimensioned to be positioned within an ear canal of a person or at an ear canal of the user. The hearing aid opening may be directed into the ear canal when the first surface is positioned in the ear canal, such as when the hearing aid housing is fully or partly positioned in the ear canal. Often, the hearing aid housing, if fully or partly positioned in the ear canal, will be fitted to the particular ear canal, or elements will be provided for engaging the ear so as to maintain the hearing aid housing in the correct position.

Alternatively, the hearing aid housing may be configured or dimensioned to be positioned at the ear canal, where the first surface is configured to be positioned at a side of the hearing aid housing facing the ear canal. In this situation, the hearing aid housing may comprise elements configured to maintain the hearing aid housing in the correct position, such as means engaging the outer ear of the person.

Naturally, the first and second surfaces may be integral with each other and may form part of the same element. The second surface is opposite in the sense that it when the first surface is directed toward the ear drum or inside the ear canal of the person, the second surface is directed outwardly of the ear canal or generally toward the surroundings of the ear or ear canal. Thus, when the hearing aid housing is positioned outside the ear canal with the first surface directed toward the ear canal, the second surface may in principle be positioned in any position facing the surroundings, such as upwardly, outwardly, downwardly or the like.

The opening is positioned in or at the second surface. The opening comprises the moisture transporting element, and for this reason, it may be desired that the second surface is positioned at a lower portion of the hearing aid housing, so that the water droplet in the housing is more easily brought into contact with the moisture transporting element.

The hearing aid housing and the transducer housing may be the same element, but usually, the hearing aid housing comprises therein the transducer as well as optionally other elements. Such other elements may be additional transducers, sound guides, electrical conductors, battery, electronics or the like. Also, usually, transducers etc. are standard or shelf products, where hearing aid housings for this use are often tailored or fitted to the individual user.

Thus, the opening is positioned in the second surface, when the hearing aid housing is the transducer housing. Otherwise, when the transducer housing is provided in the hearing aid housing, the opening is positioned at the second surface, where the second surface may comprise a hearing aid opening through which the opening or the humidity transporting element may be exposed. The transducer housing may extend out through the hearing aid opening, or the outer surface of the transducer housing where the opening is provided, may be positioned at the hearing aid opening, so that humidity from the humidity transporting element may evaporate and travel toward the surroundings of the ear.

In one situation, the housing may be configured to, such as shaped to, have a predetermined direction in relation to the ear canal of the user, and wherein the transducer is positioned within the hearing aid housing so that the opening, in the first chamber, is positioned in or at a lower surface of the first chamber. As mentioned, the housing may be fitted to the ear or ear canal or may have elements fixing the housing in or at the ear canal in a particular manner. In this manner, the positioning and rotation of the transducer may be selected, especially when having the hydrophobic/hydrophilic surface areas.

A final aspect of the invention relates to a method of operating a transducer according to the first aspect of the invention, the method comprising receiving humid air in the first chamber, condensing water from the air, bringing the condensed water into contact with the moisture transporting element, the moisture transporting element transporting at least part of the water to the outside of the housing.

In this situation, the humid air may be air in or from the ear canal, which travels into the transducer while the transducer is provided at or in the ear canal, such as through an opening therein.

The condensing step may comprise the humidity in the air impinging on or being cooled by a surface of the transducer housing, such as a housing exposed to cooler temperatures than temperatures in the ear canal, such as surfaces exposed to surroundings of the ear or ear canal.

Even when the hearing aid housing is positioned fully in the ear canal, a surface of the housing will not touch the ear canal and will be directed outwardly of the ear canal. This surface will usually be cooler than the ear canal.

The step of bringing the condensed water into contact with the humidity transporting element may be a step of moving or rotating the transducer or hearing aid in order to, due to gravity, have the condensed water travel to the desired location.

The step of transporting the condensed water to the outside of the housing is described above, where different transport methods or types are illustrated.

BRIEF DESCRIPTION OF THE DRAWINGS

In the following, preferred embodiments of the invention will be described with reference to the drawing, wherein.

DETAILED DESCRIPTION

Figure 1:
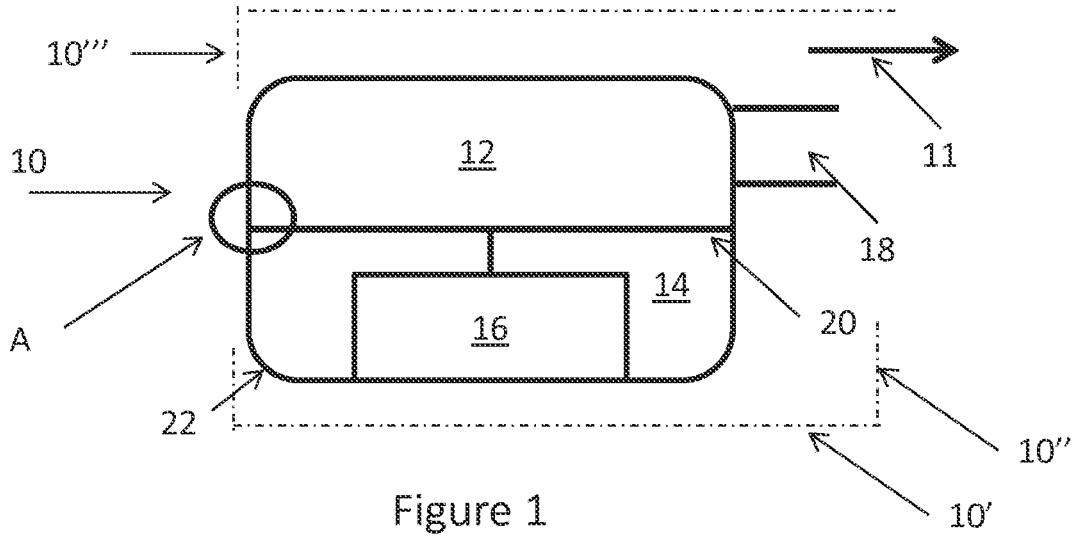
FIG. 1 illustrates a cross section of a preferred embodiment of a transducer according to the invention.

In FIG. 1, a transducer is illustrated. The transducer 10 has a housing 22 comprising a diaphragm 20 dividing the housing into two chambers 12 and 14.

The transducer may be a receiver or sound generator, whereby the diaphragm 20 is moved in accordance with a signal received and by a driver or motor unit 16 configured to receive the signal and drive the diaphragm 20 through a drive pin. The sound generated is output by the opening 18.

Alternatively, the transducer 10 may be a microphone, whereby sound is received by the opening 18 in order to move the diaphragm 20, where the unit 16 then is a movement sensing unit 16 which senses the movement of the diaphragm 20 and outputs a corresponding signal.

Further alternatively, the transducer 10 may be configured to sense vibration/acceleration or other physical properties such as air pressure.

As mentioned above, a problem encountered especially when the transducer 10 is positioned in an ear canal is that of humidity entering the transducer 10 and condensing therein. The transducer or a housing thereof may block the ear canal to a degree that the humidity therein is high. The difference in temperature of the transducer when within and when outside the ear canal will eventually generate water droplets in the transducer.

In other situations, transducers are worn outside the ear, such as behind the ear (BTE), where they are exposed to the weather, such as rain and humid surroundings.

Naturally, this may especially be a problem when the opening 18 (direction 11) is positioned on the side of the transducer facing the inner ear of the user, which is the case when the transducer is used for generating sound. However, the same position may be used for a microphone positioned to sense sound within the ear canal. Also, when the transducer is positioned deeply within the ear canal, even openings 18 facing toward the surroundings may receive enough humidity to form water droplets within the transducer 10.

A water droplet may destroy the motor/sensing unit 16 and may attach itself to the diaphragm 20 so as to make it heavier and thus interfere with or alter the sound generated or sensed. Additionally, a water droplet may short circuit other parts or circuits in the transducer 10.

Figure 2:
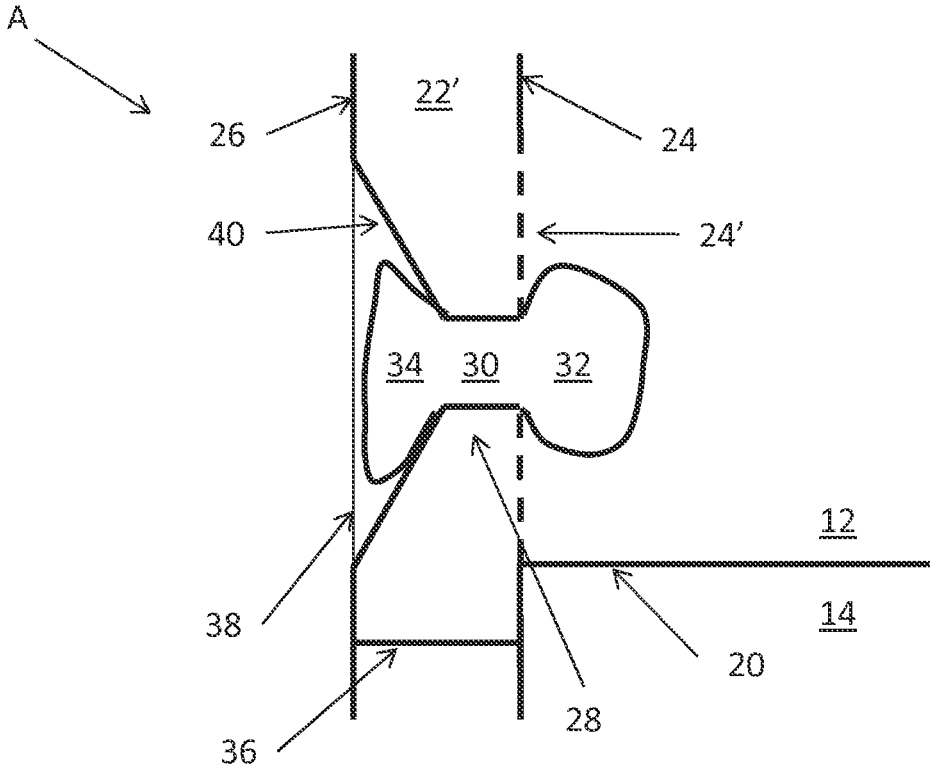
FIG. 2 illustrates an enlargement of FIG. 1 and FIGS. 3 and 4 illustrate different types of moisture transporting elements.

In FIG. 2, an enlargement is seen of the area A indicated in FIG. 1. It is seen that an opening 28 is provided through the wall 22' of the housing 22. In the embodiment illustrated the opening 28 opens from the surroundings into the chamber 12. In another embodiment, the opening A may open into a battery compartment of the shell housing directly or via a channel terminating in the battery compartment. In yet another embodiment wherein the shell housing comprises an occlusion vent channel, the opening A may open into the occlusion vent channel directly or via a channel terminating in the occlusion vent channel. In another embodiment, the opening A may be in open communication with a tube comprised in a sportslock assembly. In all embodiments the moisture is transported outside of the hearing aid.

In the opening 28, a humidity transporting element 30 is provided. A part, 32, of the element 30 extends into the chamber 12 and a part, 34, extends outside the channel 28 and toward the surroundings of the transducer 10.

During operation, the element 30 operates so that the part 32 catches or receives a water droplet in the chamber 12, which water is guided trough the element 30 and to the part 34 from which the water may evaporate to the surroundings. The guiding of water through the element 30 may be obtained using any of a number of manners, such as if the humidity transporting element 30 comprises one or more capillary channels into which the water is sucked, or such as if the element 30 is hydrophilic and/or absorbing and thus attracts the water and by the same effect transports the water into all parts, including the part 34, of the element 30.

Figure 3:
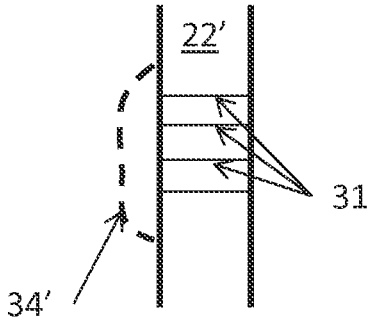
Figure 4:
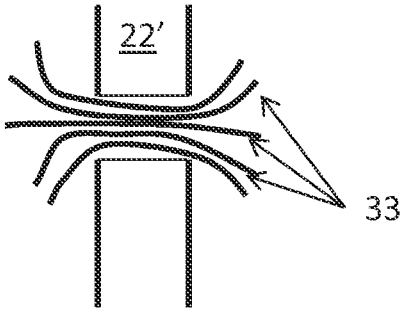

The element 30 may be formed as a single or a number of capillary channels formed directly in the wall 22', as is illustrated in FIG. 3, where capillary channels 31 perform the humidity draining. Alternatively, the element 30 may be formed by an element, such as an assembly of oblong synthetic elements 33, such as a thread, forming the capillary channels, as is seen in FIG. 4. The thread or oblong synthetic elements may be hydrophilic if desired.

Alternatively, the element 30 may be an absorbing element, such as a cotton thread, which will absorb the water and guide it also to the part 34 from which the water may evaporate, making further water transport possible.

Different materials for the element 30—absorbing materials, hydrophilic material, materials forming capillaries such an open foam or sponge-like material placed inside a small tube.

The part 34 may simply be exposed to the surroundings, or it may be protected, such as, as illustrated, when positioned in a cavity 40 provided in the wall 22'. The cavity 40 may be covered by a breathable element, such as a weave, a nonwoven or a cloth 38.

The part 34 may be positioned within the wall so as to be protected or have a more limited surface toward the surroundings.

The fanning out of the part 34, however, increases the area thereof and thus the evaporation of the collected humidity. If the element 30 is made of thread, fibres or other types of multiple elongated elements, the fanning out may increase the surface many times.

Preferably, at least the part 34 is absorbing. Capillary channels are well suited for attracting and transporting water, but the removal of water therefrom may be difficult. An outer part which is absorbing will have the capability of removing water from the capillary channels and thus increase water transport. In FIG. 3, a combination of capillary channels 31 and an outer, absorbing part 34' is seen, where the absorbing, outer element 34' may e.g. be cotton or another absorbing material. To enhance the removal of water the capillaries may fan out towards the absorbing material, the wall thickness of the capillaries may run thinner or other measures that increase the area engaging the absorbing material.

Reverting to FIG. 2, naturally, a similar water draining assembly may alternatively or additionally be provided for draining water or moisture from the chamber 14.

Usually in transducers, the chamber 12 into which the opening 18 opens, needs no pressure equalization, but the chamber 14, which for audio purposes may be considered closed, may need a small vent toward the surroundings in order to be able to equalize the gas pressure therein, when the pressure of the surroundings, and thus the pressure over the diaphragm 20, changes. This effect is seen when diving, riding in an elevator or travelling by airplane.

To perform this pressure equalization, a standard vent 36 may be provided through the wall 22' from the chamber 14 and to the surroundings. A standard vent has a cross section sufficiently small to ensure that any sound able to pass it has a sufficiently low frequency to not interfere with the operation of the transducer. Alternatively, a vent may be provided in the diaphragm 20 and to the chamber 12.

When the vent 36, as illustrated in FIG. 1, is directed toward the surroundings of the receiver (and not the direction 11), the amount of humidity entering the chamber 14 may be kept low.

A further alternative may to provide the vent in the element 30.

In order to ensure that the water droplet will come into connection with the part 32, the inner surfaces of the chamber 12, such as the inner surfaces of the transducer wall 22' forming part of the chamber 12, as well as the upper surface of the diaphragm 20, may be made hydrophobic, such as by nano-coating. However, the area 24' around the part 32 may be made hydrophilic, so that the water droplet will "hover" over the hydrophobic surfaces in the chamber 12 until reaching the area 24' where the droplet will be able to settle and thus come into contact with the part 32.

As mentioned above, a preferred use of the transducer 10 is in an In The Canal receiver (RIC) or an In The Ear hearing aid (ITE), in which a hearing aid or a receiver is positioned in the ear canal of a user.

Thus, usually, the transducer 10 is provided inside a shell 10' which is fitted to the ear canal of the user with the direction 11, and a surface 10'', toward the inner ear of the user. An opposite surface, 10''', is directed out of the ear canal and has an opening through which the opening 28 (see below) is exposed.

Thus, when in use, the transducer 10 has a predetermined orientation in relation to the head of the user. Then, the transducer 10 may be orientated in the shell 10' so that the area 24' is positioned, when e.g. the user is standing up, at the bottom of the chamber 12, so that the probability of a water droplet reaching the area 24' is high. Alternatively, the area 24' and the position of the opening 28 and the element 30 may be selected so as to be at a lower surface of the transducer 10, when positioned in the shell 10', in order to increase this probability.

In other situations, the shell 10' comprises other elements, such as a so-called Sports Lock, which acts to position and maintain the receiver 10 in the ear. This Sports Lock is an elongate, bendable element attached to the shell 10' and which is attached to or biased toward a predetermined part of the ear of the user. This Sports Lock may comprise therein the part 34, so that the large surface of this elongated part as well as its position at the outer ear of the person will aid in the evaporation of collected water. The part 34 may also, in that situation, be covered by a breathable layer 38.

The invention claimed is:

1. A transducer comprising a housing having: a wall portion defining an outer surface and an inner surface, the inner surface defining at least part of a first chamber, the wall portion comprising an opening from the inner surface to the outer surface, a diaphragm having a first surface defining at least a part of the first chamber, a humidity or moisture transporting element positioned in the opening in the wall portion and arranged to remove from the chamber humidity or moisture present inside the chamber.

2. A transducer according to claim 1, wherein the moisture transporting element comprises one or more capillary channels.

3. A transducer according to claim 1, wherein the humidity or moisture transporting element comprises a fibre.

4. A transducer according to claim 1, wherein the humidity or moisture transporting element comprises a hydrophilic element.

5. A transducer according to claim 1, wherein the humidity or moisture transporting element comprises a hydrophobic element.

6. A transducer according to claim 1, wherein the humidity or moisture transporting element comprises an outer part positioned at or outside the outer surface.

7. A transducer according to claim 6, wherein the outer part comprises a water absorbing element.

8. A transducer according to claim 6, wherein the outer part comprises a hydrophilic element.

9. A transducer according to claim 6, wherein the outer part has a shape that, compared to a cross section of the opening, fans out in a direction away from the housing.

10. A transducer according to claim 6, wherein the outer part is covered by a breathable element.

11. A transducer according to claim 1, wherein a predetermined area of the inner surface at or around the opening is hydrophilic and where other parts of the inner surface are hydrophobic.

12. A hearing aid comprising a transducer according to claim 1 and a hearing aid housing, the hearing aid housing having:

a first surface and a second surface opposite to the first surface, a hearing aid opening configured to be directed into the ear canal of a user, the hearing aid opening being positioned in the first surface, where the opening is positioned in or at the second surface.

13. A hearing aid according to claim 12, wherein the housing is configured to have a predetermined direction in relation to the ear canal of the user, and wherein the transducer is positioned within the hearing aid housing so that the opening, in the first chamber, is positioned in or at a lower surface of the first chamber.

14. A hearing aid according to claim 13, wherein the humidity or moisture transporting element extends from the transducer opening to a hearing aid opening.

15. A hearing aid comprising a housing having: a wall portion defining an outer surface and an inner surface, the inner surface defining at least part of a first chamber, the wall portion comprising an opening from the inner surface to the outer surface, a diaphragm having a first surface defining at least a part of the first chamber, a humidity or moisture transporting element positioned in the opening in the wall portion and arranged to remove from the first chamber humidity or moisture present inside the first chamber.

16. A hearing aid according to claim 15, wherein the housing is configured to have a predetermined direction in relation to the ear canal of the user, and wherein the transducer is positioned within the hearing aid housing so that the opening, in the first chamber, is positioned in or at a lower surface of the first chamber.

17. A method of operating a transducer according to claim 1, the method comprising receiving humid air in the first chamber, condensing water from the air, bringing the condensed water into contact with the humidity or moisture transporting element, the humidity or moisture transporting element transporting at least part of the water to the outside of the housing.

* * * * *